United States Patent [19]

Takabayashi

[11] Patent Number: 4,947,726

[45] Date of Patent: Aug. 14, 1990

[54] ELECTRONIC MUSICAL INSTRUMENT AND STRING DEVIATION SENSOR ARRANGEMENT THEREFOR

[75] Inventor: Youjiro Takabayashi, Shizuoka, Japan

[73] Assignee: Yamaha Corporation, Shizuoka, Japan

[21] Appl. No.: 176,328

[22] Filed: Mar. 31, 1988

[30] Foreign Application Priority Data

Apr. 3, 1987 [JP] Japan ..... 62-83289
Apr. 3, 1987 [JP] Japan ..... 62-83290

[51] Int. Cl.[5] ..... G10H 3/00; G10H 1/00

[52] U.S. Cl. ..... 84/743; 84/723; 84/724; 84/730; 84/731

[58] Field of Search ..... 84/1.16, 1.15, 1.14, 84/DIG. 24, DIG. 30, 1.18, 1.01, 1.28, DIG. 19; 250/229, 221; 73/597

[56] References Cited

U.S. PATENT DOCUMENTS

| | | | |
|---|---|---|---|
| 3,562,399 | 2/1971 | Yamauchi et al. | 84/1.25 |
| 3,902,395 | 9/1975 | Avant . | |
| 4,292,875 | 10/1981 | Nourney | 84/1.14 |
| 4,321,852 | 3/1982 | Young, Jr. . | |
| 4,516,462 | 5/1985 | Schulze | 84/1.25 X |
| 4,567,805 | 2/1986 | Clevinger | 84/1.15 X |
| 4,630,520 | 12/1986 | Bonanno . | |
| 4,653,376 | 3/1987 | Allured et al. | 84/1.16 |
| 4,658,690 | 4/1987 | Aitken et al. . | |
| 4,669,482 | 6/1987 | Ophir | 73/597 X |
| 4,676,134 | 6/1987 | Newell | 84/1.15 X |
| 4,702,141 | 10/1987 | Bonanno . | |
| 4,723,468 | 2/1988 | Takabayashi et al. | 84/1.16 |
| 4,726,275 | 2/1988 | Aitken et al. | 84/723 X |
| 4,730,530 | 3/1988 | Bonanno | 84/724 |
| 4,748,887 | 6/1988 | Marshall . | |
| 4,794,838 | 1/1989 | Corrigau . | |
| 4,817,484 | 4/1989 | Iba et al. | 84/1.01 X |
| 4,873,904 | 10/1989 | Norimatsu . | |

FOREIGN PATENT DOCUMENTS

| | | | |
|---|---|---|---|
| 8502705 | 6/1985 | European Pat. Off. . | |
| 288062 | 10/1988 | European Pat. Off. . | |
| 3108865 | 2/1983 | Fed. Rep. of Germany | 84/1.15 |

*Primary Examiner*—A. T. Grimley
*Assistant Examiner*—Matthew S. Smith
*Attorney, Agent, or Firm*—Burns, Doane, Swecker & Mathis

[57] ABSTRACT

An electronic musical instrument having (a) a body portion, (b) a plurality of fret members located at predetermined spacings on the body portion, (c) a string stretched over the body portion, (d) an anchoring device installed on the body portion for anchoring one end of the string, (e) a probe located under the string and between the anchoring device and the plural fret members for making a lateral movement responsive to a deviation of the string in a lateral direction, and (f) a string deviation detector connected to the probe for detecting the deviation of the string based on the lateral movement of the probe and producing a detection signal responsive to the deviation of the string.

21 Claims, 6 Drawing Sheets

ELECTRONIC MUSICAL INSTRUMENT AND STRING DEVIATION SENSOR ARRANGEMENT THEREFOR

FIELD OF THE INVENTION

The present invention relates in general to an electric or electronic sound-producing system including a musical instrument of the fretted and stringed type in addition to a signal controlled tone generator and particularly to a fretted and stringed musical instrument to form part of such a sound-producing system. The present invention also relates to a string deviation detector device for use in an electric or electronic musical instrument of the fretted and stringed type for detecting lateral deviation of a string of the musical instrument. An electric or electronic musical instrument to which the present invention appertains is of the fretted and stringed type and may thus be by way of example of the guitar, mandolin, banjo, balalaika or lute type.

BACKGROUND OF THE INVENTION

With a fretted and stringed electric or electronic musical instrument, musical sound is produced with various tones generated through detection of the timings at which strings are plucked and the locations of the fret members against which the strings being plucked are pressed on the fingerboard. The location of the fret member against which a string is pressed can be detected by the use of an electromagnetic pickup device responsive to the vibrations of the string for producing an analog signal varying with the waveform of the vibrations. The signal thus produced by the magnetic pickup device is monitored to detect the peaks of the signal waveform for determining the location of the fret member from the time interval between successive two peaks of the waveform. The detection of the locations of the fret members on the basis of such a signal however involves a problem in that the signal is produced with a considerable amount of delay after the player has plucked the string. This delay gives the player of the instrument a feeling of mistiming.

With a view to providing a solution to such a problem, an electronic musical instrument is proposed in Japanese Patent Application No. 60-240138 which relates to an electronic musical instrument having a fret-position sensor of a supersonic wave type. The fret-position sensor comprises piezoelectric transducer elements provided in conjunction with the individual strings of the musical instrument and responsive to timing signals cyclically supplied from a control circuit. Each of the piezoelectric transducer elements is operative to generate vibrations with a certain supersonic frequency each time the piezoelectric transducer element is activated with a timing signal. The vibrations generated by the piezoelectric transducer element are transmitted through the string engaged by the piezoelectric transducer element to the fret member against which the string is currently pressed. The vibrations which have reached the particular fret member are then "reflected" backwardly from the fret member to the piezoelectric transducer element and enable the sensor to produce an electric signal when the vibrations reflected are returned to the sensor. From the electric signal thus produced by the piezoelectric transducer element is detected the time duration for which the vibrations have been transmitted to the fret member and backwardly from the fret member to the piezoelectric transducer element. Such a time duration depends on the distance of the fret member from the piezoelectric transducer element and is accordingly representative of the location of the fret member with respect to the piezoelectric transducer element. Thus, the location of the fret member against which a string is pressed is in this manner detected from the electric signal supplied from the piezoelectric transducer element associated with the string.

In the meantime, there is known and used a "bent-string" playing technique with which a string is forced to sidewise slide on a fret member to produce a rising intonation. When such a technique is used during playing of a musical instrument having a fret-position sensor of the described nature, the sensor could not detect the mode of playing and for this reason the sound producing system could not produce the player's intended rising intonation. This is primarily because of the fact that the sensor depends for its operation merely on the period of time for which vibrations are transmitted to a fret member and backwardly from the fret member to the sensor.

The present invention contemplates elimination of such a drawback inherent in a prior-art fret-position sensor of the described nature and accordingly in an electric or electronic sound producing system using such a fret-position sensor in a musical instrument of the fretted and stringed type.

SUMMARY OF THE INVENTION

In accordance with one outstanding aspect of the present invention, there is provided an electronic musical instrument comprising (a) a body portion; (b) a plurality of fret members located at predetermined spacings on the body portion; (c) a string stretched over the body portion, (d) anchoring means installed on the body portion for anchoring one end of the string; (e) probing means, located under the string and between the anchoring means and the plurality of fret members, for making a lateral movement responsive to a deviation of the string in a lateral direction; and (f) string deviation detecting means connected to the probing means for detecting the deviation of the string based on the lateral movement of the probing means and producing a detection signal responsive to the deviation of the string.

BRIEF DESCRIPTION OF THE DRAWINGS

The drawbacks of a prior-art electronic musical instrument and the features and advantages of a musical instrument according to the present invention will be more clearly understood from the following description taken in conjunction with the accompanying drawings in which like reference numerals designate similar or corresponding units, elements and portions and in which.

DESCRIPTION OF THE PRIOR ART

The general arrangement of a known musical instrument of the type to which the present invention appertains will now be described in more detail with reference to FIG. 1 of the drawings. The musical instrument herein shown is of the guitar type but may be understood to be representative of a fretted and stringed electric or electronic musical instrument of any of the types hereinbefore enumerated.

Figure 1:
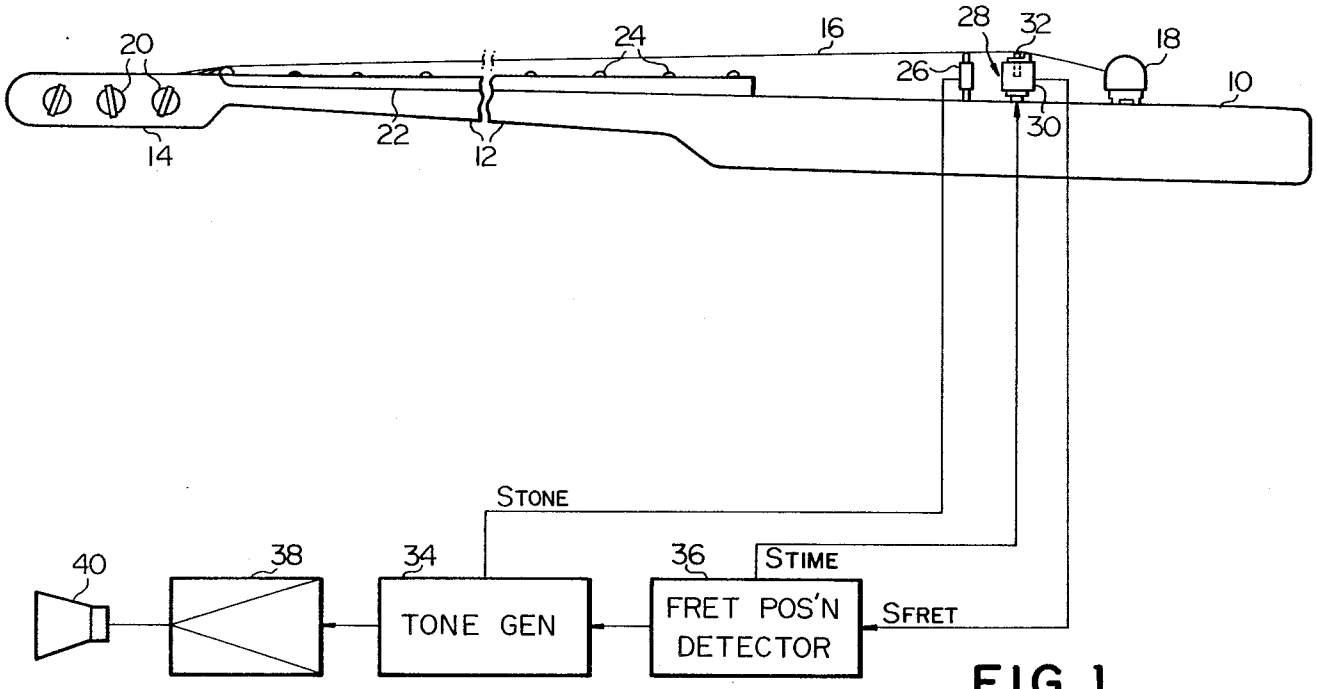
FIG. 1 PRIOR ART
FIG. 1 shows in a side elevation view an example of a known musical instrument of the type to which the present invention appertains and in a block diagram the general circuit arrangement of the sound producing system including the musical instrument.

Referring to FIG. 1, the musical instrument of the guitar type comprises a body portion 10, a neck portion 12 extending forwardly from the body portion 10, and a head portion 14, further extending forwardly from the neck portion 12. A plurality of strings 16 are anchored each at one end to a tailpiece 18 fixedly attached to the body portion 10 and have leading end portions rolled round tuning pegs 20 fitted to the head portion 14 to permit adjustment of the tension in each of the strings 16. On the neck portion 12 of the instrument is mounted a fingerboard 22 on which a plurality of fret members 24 are located at predetermined spacings from one another.

The musical instrument further comprises a tone detector unit 26 composed of a plurality of electromagnetic pickup elements respectively engaging the strings 16. Each of the pickup elements of the tone detector unit 26 is responsive to the vibrations of relatively low frequencies of the associated one of the strings 16 and is operative to produce an analog output signal $S_{TONE}$ which is variable in waveform with the waveform of the vibrations of the string 16. In addition to the tone detector unit 26 is provided a fret-position detector unit 28 including a bridge member 30 fixedly attached to and extending laterally of the body portion 10 of the instrument. On the bridge member 30 are mounted a plurality of piezoelectric transducer elements 32 which are arranged along the bridge member 30 to engage the individual strings 16, respectively.

The pickup elements of the tone detector unit 26 are electrically connected to a tone generator 34 which is operative to generate musical tones in response to the signals $S_{TONE}$ respectively supplied from the pickup elements. On the other hand, the piezoelectric transducer elements 32 of the fret-position detector unit 28 are electrically connected to a fret-position detect circuit 36 connected to the tone generator 34. The fret-position detect circuit 36 supplies a succession of timing pulses $S_{TIME}$ to each of the piezoelectric transducer elements 32 so that each time a timing pulse $S_{TIME}$ is applied to the piezoelectric transducer elements 32, each piezoelectric transducer element 32 generates vibrations of a predetermined supersonic (or ultra-audible) frequency of, for example, 450 KHz. The tone generator 34 is connected through an amplifier 38 to a speaker unit 40.

The supersonic-frequency vibrations generated by each piezoelectric transducer element 32 are transmitted through the string 16 engaged by the piezoelectric transducer element 32 to the fret member 24 against which the particular string 32 is currently pressed. The vibrations which have reached such a fret member 24 are then reflected or "echoed" backwardly from the fret member 24 to the piezoelectric transducer element 32 and enable the transducer element 32 to produce an electric signal $S_{FRET}$ when the vibrations reflected from the fret member 24 are returned to the piezoelectric transducer element 32. From the electric signal $S_{FRET}$ produced by the piezoelectric transducer element is detected the time duration for which the vibrations have been transmitted from the piezoelectric transducer element 32 to the fret member 24 and backwardly from the fret member 24 to the piezoelectric transducer element 32. Such a time duration depends on the distance of the fret member 24 from the piezoelectric transducer element 32 and is accordingly representative of the location of the fret member 24 with respect to the piezoelectric transducer element 24. Thus, the location of a fret member 24 against which a string 16 is pressed is in this manner detected from the electric signal $S_{FRET}$ supplied from the piezoelectric transducer element 32 associated with the particular string 16.

The fret-position detector unit 28 depends for its operation merely on the period of time for which vibrations are transmitted to and backwardly from a fret member 24 and, for this reason, the detector unit 28 could not detect a bent-string mode of playing in which a string 16 is forced to sidewise slide on the fret member 24 as noted previously. The present invention contemplates elimination of such a drawback of the prior-art fret-position detector unit 28 and accordingly in the sound producing system using such a fret-position detector unit 28 in the musical instrument of typically the described type.

DESCRIPTION OF THE PREFERRED EMBODIMENTS

Figure 2:
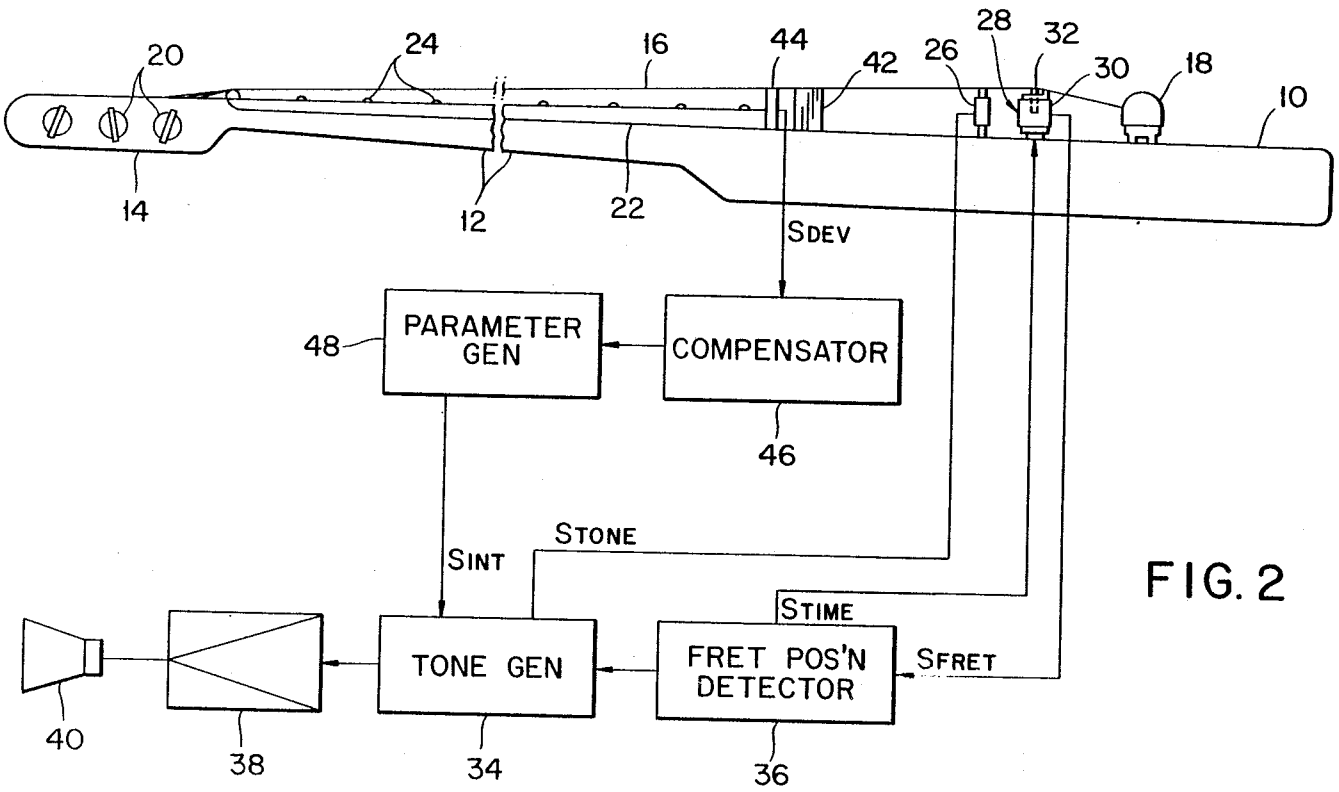
FIG. 2 is a view similar to FIG. 1 but shows a preferred embodiment of a fretted and stringed electric or electronic musical instrument according to the present invention and the general circuit arrangement of the sound producing system including the musical instrument.

Referring to FIG. 2, a musical instrument embodying the present invention is assumed to be also of the guitar type by way of example but is per se representative of a fretted and stringed electric or electronic musical instrument of any of the types hereinbefore enumerated. The musical instrument herein shown is thus similar to the prior-art musical instrument described with reference to FIG. 1 and comprises a tone detector unit 26 and a fret-position detector unit 28 respectively connected to a tone generator 34 and a fret-position detect circuit 36, respectively.

The musical instrument embodying the present invention comprises, in addition to the tone and fret-position detector units 26 and 28, a unitary or single-piece bridge member 42 located intermediate between the tone detector unit 26 and the fingerboard 22 and fixedly attached to the body portion 10 of the musical instrument. The bridge member 42 extends laterally of the body portion 10 of the instrument and is engaged by the individual strings 16 extending from the tone detector unit 26 toward the fingerboard 22. The musical instrument shown in FIG. 2 further comprises a string deviation detector unit 44 located intermediate between the bridge member 42 and the fingerboard 22 and fixedly attached in its entirety to the body portion 10 of the musical instrument. On the body portion 10 of the musical instrument are thus provided the tailpiece 18, fret-position detector unit 30, tone detector unit 26, bridge member 42 and string deviation detector unit 44 which are arranged in this sequence from the end of the body portion 10 toward the fingerboard 22 as shown.

As in the electrical arrangement of the prior-art musical instrument described with reference to FIG. 1, the tone detector unit 26 is composed of pickup elements respectively associated with the strings 16 and adapted to signals $S_{TONE}$ when the respectively associated strings 16 are plucked individually. The signals $S_{TONE}$ thus generated by the tone detector unit 26 are supplied to the tone generator 34 to enable the tone generator 34 to generate musical tones in response to the signals $S_{TONE}$. To each of the piezoelectric transducer elements 32 of the detector unit 28 is supplied a succession of timing pulses $S_{TIME}$ from the fret-position detect circuit 36 in predetermined cycles. In response to each of these timing pulses $S_{TIME}$, each of the piezoelectric transducer elements 32 of the detector unit 28 generates vibrations of a predetermined supersonic frequency within a range of from 400 KHz to 450 KHz. The supersonic-frequency vibrations generated by each piezoelectric transducer element 32 are transmitted through the string 16 engaged by the piezoelectric transducer element 32 and via the bridge member 42 and string deviation detector unit 44 to the fret member 24 against which the particular string 32 is currently pressed. The vibrations which have reached the fret member 24 are then reflected backwardly from the fret member 24 to the piezoelectric transducer element 32 via the string deviation detector unit 44 and bridge member 42 and enable the piezoelectric transducer element 32 to produce an electric signal $S_{FRET}$ when the vibrations transmitted backwardly through the string 16 reach the piezoelectric transducer element 32. In the electrical arrangement of the musical instrument embodying the present invention, the string deviation detector unit 44 is connected through a signal compensation circuit 46 and a parameter generator circuit 48 to the tone generator 34. The functions of these signal compensation circuit 46 and parameter generator circuit 48 will be described later.

The unitary bridge member 42 located intermediate between the tone detector unit 26 and string deviation detector unit 44 as above described is adapted to pass supersonic-frequency vibrations of the strings 16 from the piezoelectric transducer elements 32 of the fret-position detector unit 28 to the string deviation detector unit 44 without dampening and reflecting the vibrations. In response to the low-frequency vibrations produced in the strings 16 when the strings 16 are plucked by the instrument player's fingers or fingernails, the bridge member 42 dampens out such low-frequency vibrations and isolates the vibrations from the string deviation detector unit 44. The bridge member 42 is further effective to take up lateral displacement of the strings 16 to prevent such displacement from being transmitted to the string deviation detector unit 44. The bridge member 42 to achieve these functions is formed typically of acrylonitrile-butadiene-styrene (ABS) copolymer. The detailed construction of the string deviation detector unit 44 is illustrated in FIGS. 3A and 3B.

Figure 3A:
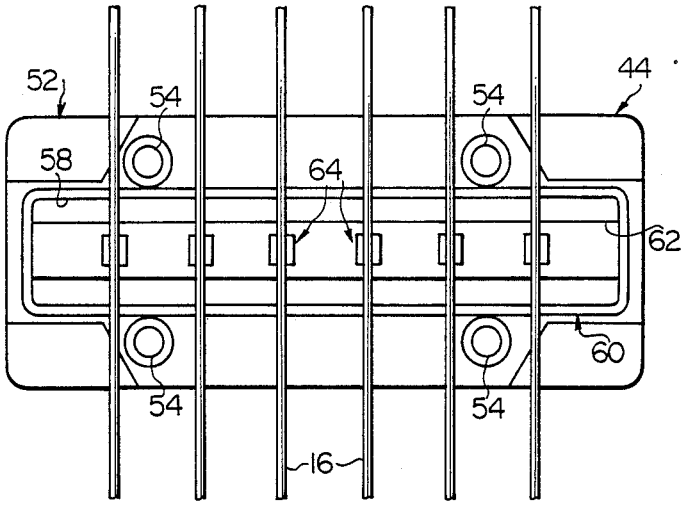
FIG. 3A is a plan view showing the construction of a string deviation detector unit forming part of the musical instrument illustrated in FIG. 2.
Figure 3B:
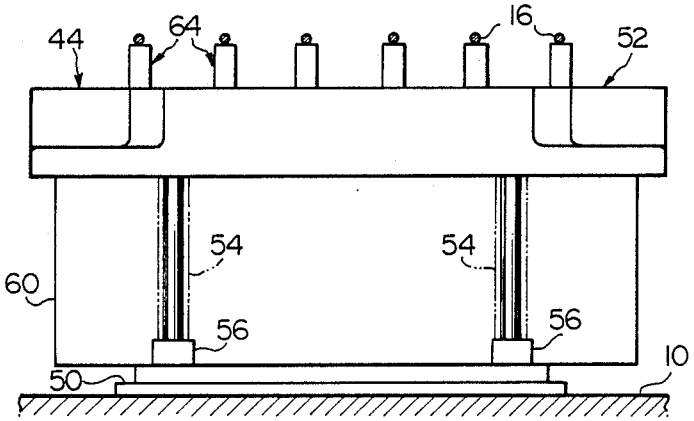
FIG. 3B is a front or rear end view of the string deviation detector unit illustrated in FIG. 3.

Referring to FIGS. 3A and 3B, the string deviation detector unit 44 provided in the musical instrument embodying the present invention comprises a support plate 50 (FIG. 3B) fixedly attached to the body portion 10 of the musical instrument and a housing 52 securely supported on the support plate 50 by means of a plurality of adjustment studs or screws 54. The studs or screws 54 extend upwardly from retaining members 56 secured to the support plate 50 and are screwed into the housing 52 so that the housing 52 is adjustably positioned at a desired height over the body portion 10 of the musical instrument as will be better seen from FIG. 3B.

Figure 4:
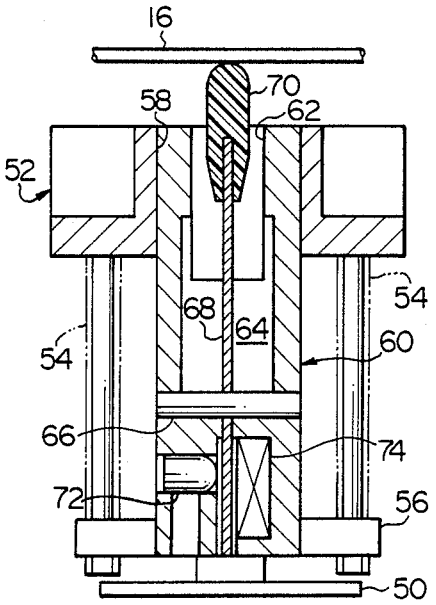
FIG. 4 is a vertical sectional view showing the construction of a deviation detecting assembly included in the string deviation detector unit illustrated in FIGS. 3A and 3B.

The housing 52 has a slot 58 which is elongated laterally of the body portion 10 of the musical instrument as will be seen from FIG. 3A and which is open upwardly and downwardly as will be further seen from FIG. 4. In this elongated slot 58 of the housing 52 is closely received an upper portion of a heat sink member 60 which is fixedly attached at its bottom end to the support plate 50. The heat sink member 60 thus upstanding from the support plate 50 also has a slot 62 which is elongated along the slot 58 in the housing 52 as will be seen from FIG. 3A and which is open upwardly and downwardly as will be seen from FIG. 4. The heat sink member 60 thus formed with the slot 62 has provided therein a plurality of deviation detecting assemblies 64 which are arranged in association with the individual strings 16, respectively, as shown in FIG. 3A. The heat sink member 60 is constructed typically of aluminum and is useful for radiating out heat from the interior of the deviation detecting assembly 64 and further as a structural support member of the deviation detecting assembly 64.

As illustrated in FIG. 4, each of the deviation detecting assemblies 64 comprises a pivot element 66 which is located below one of the strings 16, respectively. The pivot element 66 of each deviation detecting assembly 64 axially extends in parallel with the associated one of the strings 16 and is rotatable about its center axis in the housing 52. Each of the deviation detecting assemblies 64 further comprises a vertically elongated rockable member 68 which has an intermediate portion secured to the pivot element 66 of each deviation detecting assembly 64 and an upper portion extending from the pivot element 66 into the slot 62 in the upper portion of the heat sink member 60. The rockable member 68 has carried at its upper end a contact element or probe 70 projecting upwardly out of the slot 62 for being engaged at its upper end by the string 16 with which the deviation detecting assembly 64 is associated. The engagement between the string 16 and the probe 70 is maintained by frictional contact therebetween. In this instance, the pressure with which the probe 70 is thus engaged by the associated string 16 can be varied through adjustment of the vertical position of the housing 52 over the body portion 10 of the musical instrument by means of the adjustment studs or screws 54. To have the probe 70 secured to the rockable member 68, the rockable member 68 may have a threaded upper end portion screwed into the probe 70.

The rockable member 68 forming part of each of the deviation detecting assemblies 64 further has a lower portion extending from the pivot element 66 downwardly into a cavity formed in a lower portion of the heat sink member 60. The rockable member 68 thus carried on the pivot element 66 in each of the deviation detecting assemblies 64 is rockable about the center axis of the pivot element 66 with the probe 70 movable sidewise of or perpendicularly to the string 16 which engages the probe 70. The rockable member 68 of each of the deviation detecting assemblies 64 is formed typically of steel while the probe 70 of each deviation detecting assembly 64 is formed typically of a plastic such as typically acrylonitrile-butadiene-styrene copolymer.

Each of the deviation detecting assemblies 64 further comprises photoelectric coupling means provided in conjunction with the rockable member 68 of each deviation detecting assembly 64. In the embodiment herein shown, such photoelectric coupling means comprises a light emitting element 72 and a photoelectric transducer element 74 which are located so that the lower portion of the rockable member 68 is located therebetween in a direction parallel with the associated string 16. The light emitting element 72 may be implemented by an infrared ray emitting diode and the photoelectric transducer element 74 may be implemented by a photodiode or a phototransistor, by way of example. When the rockable member 68 is held in an upright position with the associated string 16 extending correctly at right angles to the probe 70, the beam of light emitted from the light emitting element 72 toward the photoelectric transducer element 74 is totally intercepted by the lower portion of the rockable member 68. As the string 16 is caused to laterally deviated, the probe 70 engaged by the string 16 is forced to move through the slot 62 in the heat sink member 60. This causes the rockable member 68 to turn about the center axis of the pivot element 66 in either direction from the upright position thereof. It therefore follows that an increasing quantity of light is allowed to reach the photoelectric transducer element 74 with the lower portion of the rockable member 68 moved away from the path of the light emitted from the light emitting element 72. Under this condition, the photoelectric transducer element 74 will produce an analog signal $S_{DEV}$ which varies in magnitude (which is typically current) continuously with the angular displacement of the lower portion of the rockable member 68 with respect to the heat sink member 60 Thus, the analog signal $S_{DEV}$ produced by the transducer element 74 is indicative of the angular displacement of the rockable member 68 from the normal upright position thereof and accordingly of the amount of lateral deviation of the associated string 16 from the direction in which the string 16 normally extends over the deviation detecting assembly 64.

The analog signal $S_{DEV}$ thus output from the transducer element 74 is supplied to the signal compensation circuit 46 and is corrected in terms of temperature and is thereafter supplied to the parameter generator circuit 48. The ambient temperature is thus detected by suitable temperature detecting means which may be provided in, for example, the string deviation detector unit 44 though not shown in the drawings and a signal representative of the detected ambient temperature is also to the signal compensation circuit 46. In response to the signal supplied from the signal compensation circuit 46, the parameter generator circuit 48 produces a signal $S_{INT}$ representative of the rising intonation to be produced for the tone to be generated in response to the signal $S_{TONE}$ from the tone detector unit 26.

During "bent-string" mode of playing with which any of the string 16 forced to sidewise slide on any of the fret members 24, the sensor could not detect the mode of playing and for this reason the sound producing system could not produce the player's intended rising intonation. This is because of the fact that the sensor depends for its operation merely on the period of time for which vibrations are transmitted to a fret member and backwardly from the fret member to the sensor.

It has been assumed that the beam of light emitted from the light emitting element 72 toward the photoelectric transducer element 74 is totally intercepted by the lower portion of the rockable member 68 when the rockable member 68 is held in the upright position with the associated string 16 extending correctly at right angles to the probe 70. If desired, however, the rockable member 68 may be shaped and/or arranged so that the beam of light emitted from the light emitting element 72 toward the photoelectric transducer element 74 is totally or in a predetermined proportion allowed to reach the transducer element 74 when the rockable member 68 is held in the upright position. For this purpose, the lower portion of the rockable member 68 may be formed with a sector-shaped aperture which is located in alignment with the path of light from the light emitting element 72. In this instance, a decreasing quantity of light is allowed to pass through such an aperture and reach the photoelectric transducer element 74 as the rockable member 68 is forced to turn from the upright position thereof with the string 16 caused to laterally deviated. The photoelectric transducer element 74 responsive to such a beam of light from the light emitting element 72 also produces an analog signal which varies in magnitude continuously with the angular displacement of the lower portion of the rockable member 68 and accordingly with the lateral deviation of the associated string 16 from the direction in which the string 16 normally extends over the deviation detecting assembly 64. The sector-shaped aperture formed in the lower portion of the rockable member 68 preferably has the center of curvature of its arc portion of the aperture located at the center axis of the pivot element 66. With this arrangement of the rockable member 68, the photoelectric transducer element 74 will produce an analog signal which varies in magnitude in direct proportion to the angular displacement of the lower portion of the rockable member 68 and accordingly to the lateral deviation of the associated string 16.

Figure 5:
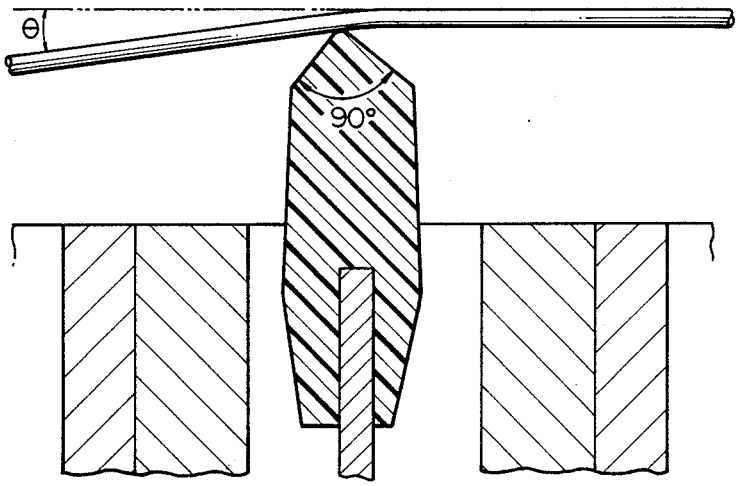
FIG. 5 is a fragmentary view showing portions of a modification of the deviation detecting assembly illustrated in FIG. 4.

The vertical position of the probe 70 with respect to the associated string 16 may be adjusted by means of the adjustment studs or screws 54 in such a manner that the string 16 extending from the top of the bridge member 42 is directed downwardly past the probe 70 at a suitable angle $\theta$ to the direction in which the string 16 extends toward the probe 70, as shown in FIG. 5. Such arrangement of the probe 70 is useful for making definite the point at which the string 16 is engaged by the probe 70 and precluding the string 16 from being disengaged from the probe 70 when the string 16 is caused to laterally deviate. In order that the probe 70 be capable of effectively dampening the lower-frequency vibrations of the string 16, the angle $\theta$ at which the string 16 is thus directed downwardly past the probe 70 is preferably selected to be less than 15 degrees. Especially where the probe 70 is formed of acrylonitrile-butadiene-styrene copolymer as previously noted, it is more preferable that the angle 8 be selected to be less than 5 degrees. The effectiveness of the probe 70 arranged in this manner will be enhanced where the probe 70 is shaped to be upwardly tapered and pointed to form an angle of about 90 degrees in a vertical plane through which the string 16 extends. Where the probe 70 is secured to the rockable member 68 with a threaded upper end portion of the rockable member 68 screwed into the probe 70, the vertical position of the probe 70 with respect to the string 16 may be adjusted not only by means of the adjustment studs or screws 54 but by adjusting such engagement between the probe 70 and the rockable member 68.

Figure 6:
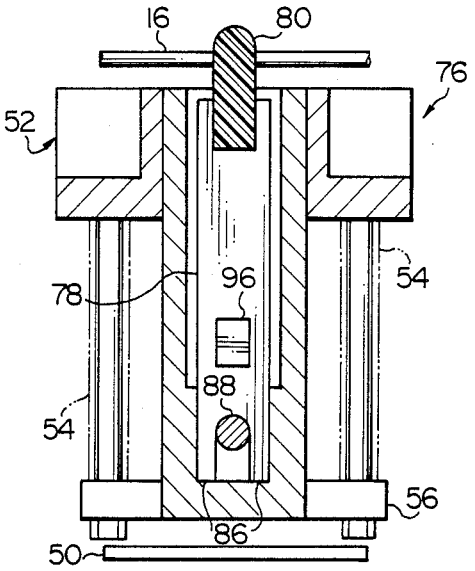
FIG. 6 is a view similar to FIG. 4 but shows another modification of the deviation detecting assembly illustrated in FIG. 4.
Figure 7:
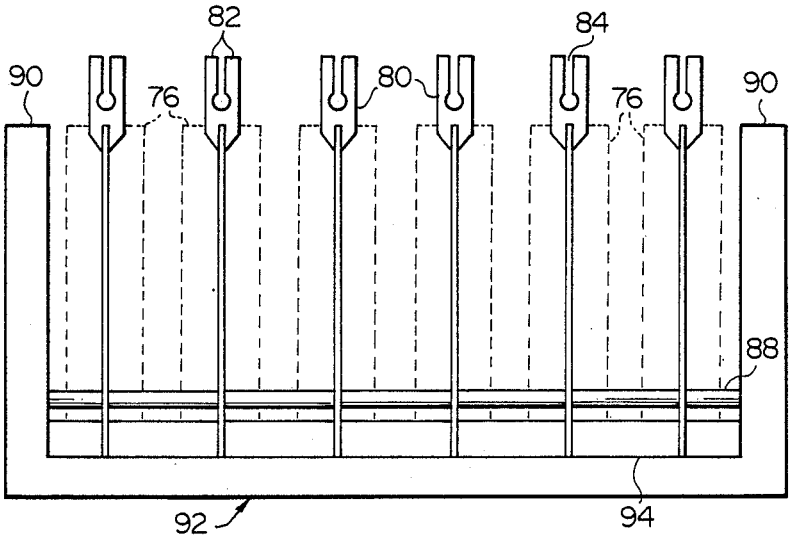
FIG. 7 is a front or rear end view of a string deviation detector unit including the modified deviation detecting assembly illustrated in FIG. 6.

FIG. 6 shows a modification of the deviation detecting assembly 64 hereinbefore described of the musical instrument embodying the present invention while FIG. 7 shows a string deviation detector unit including the modified deviation detecting assembly illustrated in FIG. 6.

In the deviation detecting assembly shown in FIG. 6 in which the deviation detecting assembly is now designated in its entirety by reference numeral 76, a rockable member 78 constructed of a thin spring steel plate has carried thereon a bifurcated contact element or probe 80. As shown in FIG. 7, the probe 80 thus carried by the rockable member 78 has a pair of limb portions 82 spaced apart from each other laterally of the associated string 16 to form a vertically elongated gap 84 therebetween. Each of the strings 16 (not shown) respectively associated with such deviation detecting assemblies 76 is passed through such a gap 82 in the bifurcated probe 80 and is elastically pressed between the limb portions 82. As will be seen from FIG. 6, the rockable member 78 of each deviation detecting assembly 76 also has a bifurcated lower end portion having a pair of leg portions spaced apart from each other in a direction parallel with the associated string 16. An elongated rod member 88 extends through the respective gaps thus formed in the bifurcated lower end portions of the rockable members 78 and is securely connected at its opposite ends to side wall portions 90 of a support structure 92 which may be integral with or securely coupled to the housing 52. The respective bifurcated end portions of the rockable members 78 of the individual deviation detecting assemblies 76 are anchored to a spacer member 94 elongated between the side wall portions 90 of the housing 92.

Figure 8:
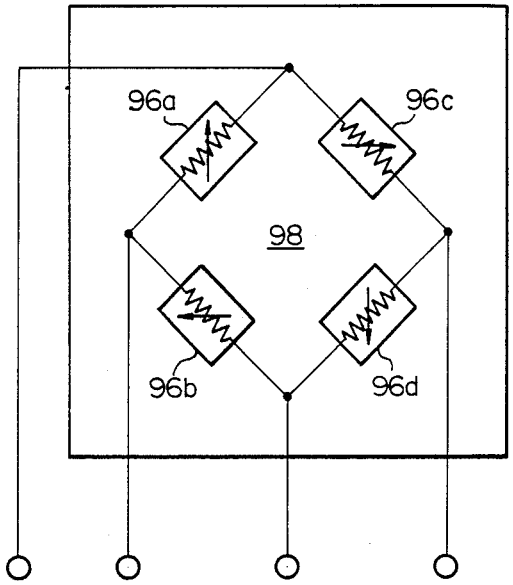
FIG. 8 is a circuit diagram showing a bridge network composed of two pairs of strain gage elements which are included in each of the deviation detecting assemblies of the string deviation detector unit illustrated in FIG. 7.

Each of the rockable members 78 thus upstanding from the spacer member 94 has attached to its side faces two pairs of strain gage elements which are represented by a strain gage plate 96 shown in FIG. 6. The total of four strain gage elements are connected in the form of a bridge network 98 as illustrated in FIG. 8 in which the individual strain gage elements are denoted by 96*a*, 96*b*, 96*c* and 96*d*, respectively. When the string 16 engaged by the probe 80 carried by such a rockable member 78 is forced to laterally deviate, the rockable member 78 is caused to angularly deform in the direction in which the rod member 88 extends and, as a consequence, the electrical resistance through each of the strain gage elements 96*a*, 96*b*, 96*c* and 96*d* varies with the amount of displacement of the rockable member 78. The amount of displacement of the rockable member 78 is thus detected as a change in the effective resistance of the bridge network 98 so that the bridge network 98 produces a signal similar in effect to the signal $S_{DV}$ to be produced by the deviation detecting assembly 64 shown in FIG. 4 or the signal $S_{INT}$ to be output from the parameter generator circuit 48 shown in FIG. 1.

Figure 9:
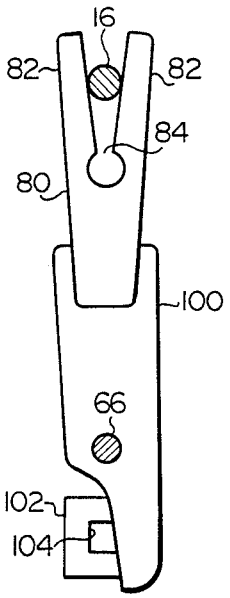
FIG. 9 is a front or rear end view of a modification of the cc forming part of the deviation detecting assembly illustrated in FIG. 7.

FIG. 9 shows a modification of the rockable member 78 forming part of the deviation detecting assembly 76 described with reference to FIG. 7. The rockable member, now represented by reference numeral 100, is intended for use in a deviation detecting assembly similar to the deviation detecting assembly 64 of the nature described with reference to FIG. 4. As shown, the rockable member 100 is pivotally supported on the pivot element 66 and has an apertured member 102 securely attached to a lower end portion of the rockable member 100. The apertured member 102 is formed with a generally square-shaped aperture 104 which is located in alignment with the path of light from a light emitting element similar to the element 72 included in the deviation detecting assembly 64 described with reference to FIG. 4. As the rockable member 100 is forced to turn from the upright position thereof with the string 16 caused to laterally deviated, a decreasing quantity of light is allowed to pass through the aperture 104 and reach a photoelectric transducer element similar to the element 74 in the deviation detecting assembly 64 described with reference to FIG. 4. The photoelectric transducer element responsive to such a beam of light from the light emitting element produces an analog signal which varies in magnitude continuously with the angular displacement of the lower portion of the rockable member 100 and accordingly with the lateral deviation of the associated string 16 from the direction in which the string 16 normally extends over the deviation detecting assembly. With this arrangement of the rockable member 100, the photoelectric transducer element will produce an analog signal which varies in magnitude in direct proportion to the angular displacement of the lower portion of the rockable member 100 and accordingly to the lateral deviation of the associated string 16.

What is claimed is:

1. An electronic musical instrument comprising (a) a body portion;

(b) a plurality of fret members located at predetermined spacings on said body portion;

(c) a string stretched over said body portion, (d) anchoring means installed on said body portion for anchoring one end of said string;

(e) probing means located between said anchoring means and said plurality of fret members, engaging said string and attaching to said body portion for being movable with the string in a lateral direction of said body portion; and (f) string deviation detecting means connected to said probing means for detecting an amount of lateral movement of said probing means corresponding to the lateral movement of the string caused by a player's performance and producing a signal variable with an amount of deviation of said string in said lateral direction.

2. An electronic musical instrument as set forth in claim 1, further comprising (g) a bridge member located intermediate between said anchoring means and said probing means and fixedly attached to said body portion, said bridge member extending laterally of said body portion and being engaged by said string for passing supersonic-frequency vibrations of said string to said probing means without dampening and reflecting the supersonic-frequency vibrations and for dampening out low frequency vibrations of said string and isolating the low-frequency vibrations from said probing means.

3. An electronic musical instrument comprising (a) a body portion, (b) a plurality of fret members located at predetermined spacings from said body portion, (c) a plurality of strings anchored each at one end to said body portion and extending over said fret members, (d) tone detector means comprising a plurality of electromagnetic pickup elements respectively engaging said strings, each of the pickup elements of said tone detector means being responsive to the vibrations of relatively low frequencies of each of said strings and being operative to produce a signal which is variable in waveform with the waveform of the vibrations of the string, (e) fret-position detector means including a plurality of piezoelectric transducer elements arranged laterally of said body portion and respectively engaging said strings, (f) control means operative to supply a succession of timing pulses to each of said piezoelectric transducer elements in predetermined cycles so that each time a timing pulse is applied to the piezoelectric transducer elements, each of said piezoelectric transducer elements generates vibrations of a predetermined supersonic frequency, and (g) string deviation detector means located intermediate between said tone detector means and said plurality of fret members and fixedly attached in its entirety to said body portion, said string deviation detector means being operative to produce lateral displacement responsive to deviation of each of said strings in a lateral direction of said body portion and to produce a signal variable with a detected amount of lateral deviation of each string.

4. An electronic musical instrument as set forth in claim 3, further comprising (h) a head portion extending from said neck portion, (i) a bridge member located intermediate between said tone detector means and said string deviation detector means and fixedly attached to said body portion, said bridge member extending laterally of said body portion and being engaged by said strings extending from the tone detector means toward said head portion, said bridge member being adapted to pass supersonic-frequency vibrations of each of said strings from the piezoelectric transducer elements of said fret-position detector means to said string deviation detector means without dampening and reflecting the supersonic-frequency vibrations and to dampen out low-frequency vibrations of each of said strings and isolate the low-frequency vibrations from said string deviation detector means, said bridge member being further adapted to take up lateral displacement of each of said strings to prevent such displacement from being transmitted to the string deviation detector means.

5. An electronic musical instrument comprising (a) a body portion;

(b) a neck portion extending forwardly from the body portion, (c) a head portion extending from said neck portion, (d) a plurality of strings anchored each at one end to said body portion and extending to the head portion, (e) a plurality of fret members located at predetermined spacings from one another on said neck portion, (f) tone detector means comprising a plurality of electromagnetic pickup elements respectively engaging said strings, each of the pickup elements of said tone detector means being responsive to the vibrations of relatively low frequencies of each said strings and being operative to produce a signal which is variable in waveform with the waveform of the vibrations of the string, (g) fret-position detector means including a plurality of piezoelectric transducer elements arranged laterally of said body portion and respectively engaging said strings, (h) control means operative to supply a succession of timing pulses to each of said piezoelectric transducer elements in predetermined cycles so that each time a timing pulse is applied to the piezoelectric transducer elements, each of said piezoelectric transducer elements generates vibrations of a predetermined supersonic frequency, (i) string deviation detector means located intermediate between said tone detector means and said neck portion and fixedly attached in its entirety to said body portion, said string deviation detector means being operative to produce lateral displacement responsive to deviation of each of said strings in a lateral direction of said body portion for producing a signal variable with a detected amount of lateral deviation of each string, (j) a bridge member located intermediate between said tone detector means and said string devication detector means and fixedly attached to said body portion, said bridge member extending laterally of said body portion and being engaged by said strings extending from the tone detector means toward said head portion, said bridge member being adapted to pass supersonic-frequency vibrations of each of said strings from the piezoelectric transducer elements of said fret-position detector means to said string deviation detector means without dampening and reflecting the supersonic-frequency vibrations and to dampen out low-frequency vibrations of each of said strings and isolate the low-frequency vibrations from said string deviation detector means, said bridge member being further adapted to take up lateral displacement of each of said strings to prevent such displacement from being transmitted to the string deviation detector means.

6. An electronic musical instrument as set forth in any one of claims 1 to 5, in which said musical instrument comprises a plurality of deviation detecting assemblies arranged laterally of said body portion in association with said strings, respectively, each of said deviation detecting assemblies comprising a rockable member rockable about an axis fixed with respect to said body portion, a contact element secured to said rockable member and engaging the string with which the deviation detecting assembly is associated, and photoelectric coupling means provided in conjunction with said rockable member and arranged such that, in response to lateral displacement of the string with which said deviation detecting assembly is associated, the contact element engaged by the string is forced to move with the string and said rockable member is caused to turn about said axis in either direction so that a beam of light emitted from a light emitting element is allowed to reach said photoelectric coupling means in a variable proportion with the lower portion of the rockable member moved away from the path of the light emitted from the light emitting element, said photoelectric coupling means being operative to produce a signal which varies in magnitude with the angular displacement of the lower portion of said rockable member with respect to said support member.

7. An electronic musical instrument as set forth in any one of claims 1 to 5, in which said musical instrument comprises (A) a housing fixedly attached to said body portion, (B) a support member which is fixedly held in said housing and having a slot which is elongated laterally of said body portion and which is open upwardly and downwardly, said support member being effective to radiating out heat from the interior of the deviation detecting assembly, (C) a plurality of deviation detecting assemblies provided in said slot and arranged in association with said strings, respectively, each of said deviation detecting assemblies comprising a pivot element located below each of said strings and axially extending substantially in parallel with the associated one of the strings, said pivot element being rotatable about its center axis in said housing, a vertically elongated rockable member which has an intermediate portion secured to said pivot element, an upper portion extending into the slot in said support member and a lower portion extending downwardly from said pivot element, a contact element extending from said rockable member and projecting upwardly out of said slot for being engaged by the string with which the deviation detecting assembly is associated, said rockable member being rockable about the center axis of said pivot element with said contact element movable sidewise of the string engaging the contact element, and photoelectric coupling means comprising a light emitting element and a photoelectric transducer element, said light emitting element and said photoelectric transducer element being arranged so that, in response to lateral displacement of the string with said deviation detecting assembly is associated, the contact element engaged by the string is forced to move with the string and said rockable member is caused to turn about the center axis of the pivot element in either direction so that a beam of light emitted from said light emitting element is allowed to reach said photoelectric transducer element in a variable proportion with the lower portion of the rockable member moved away from the path of the light emitted from the light emitting element, said photoelectric transducer element being operative to produce a signal which varies in magnitude continuously with the angular displacement of the lower portion of said rockable member with respect to said support member.

8. An electronic musical instrument as set forth in claim 7, in which said housing is fixedly attached to said body portion by means of a plurality of adjustment elements, said adjustment elements extending upwardly from said body portion and being adjustably coupled to said housing so that the housing is adjustably positioned at a desired height over said body portion.

9. An electronic musical instrument as set forth in claim 7, in which said contact element of each of said deviation detecting assemblies is formed of a plastic such as typically acrylonitrile-butadiene-styrene copolymer.

10. An electronic musical instrument as set forth in claim 7, in which the engagement between said contact element and the associated one of said strings is maintained by frictional contact therebetween.

11. An electronic musical instrument as set forth in claim 7, in which the lower portion of said rockable member is formed with an aperture which is located substantially in alignment with the path of light from said light emitting element toward said photoelectric transducer element.

12. An electronic musical instrument as set forth in claim 7, in which the lower portion of said rockable member is formed with a sector-shaped aperture which is located in alignment with the path of light from said light emitting element toward said photoelectric transducer element.

13. An electronic musical instrument as set forth in claim 12, in which said sector-shaped aperture has the center of curvature of its arc portion of the aperture located at the center axis of the pivot element.

14. An electronic musical instrument as set forth in claim 7, in which said housing has over said body portion a vertical position which is such that the string extending from said bridge member is directed downwardly past said contact element at a predetermined angle to the direction in which the string extends toward the contact element.

15. An electronic musical instrument as set forth in claim 14, in which said predetermined angle is less than 15 degrees.

16. An electronic musical instrument as set forth in claim 14, in which said predetermined angle is less than 5 degrees.

17. An electronic musical instrument as set forth in claim 14, in which said contact element is shaped to be upwardly tapered and pointed to form an angle of about 90 degrees in a vertical plane through which the associated string extends.

18. An electronic musical instrument as set forth in claim 14, in which said contact element is bifurcated to have a pair of limb portions spaced apart from each other laterally of the associated string to form a vertically elongated gap therebetween, each of said strings respectively associated with said deviation detecting assemblies being passed through said gap and being elastically pressed between said limb portions.

19. An electronic musical instrument as set forth in claim 14, in which said rockable member has attached to its side faces a plurality of strain gauge elements which are electrically connected in the form of a bridge network.

20. An electronic musical instrument comprising (a) a body portion;

(b) a plurality of fret members located at predetermined spacings on said body portion;

(c) a string which is stretched over said body portion, (d) anchoring means installed on said body portion for anchoring one end of said string;

(e) string deviation detector means located between said anchoring means and said plurality of fret members; and (f) engaging means for engaging said string and said string deviation detector means so that said string deviation detector means is operative to produce lateral displacement responsive to deviation of said string in a lateral direction of said body portion and produce a signal representing an amount of lateral deviation of said string.

21. An electronic musical instrument comprising (a) a body portion;

(b) a plurality of fret members located at predetermined spacings from said body portion, (c) a plurality of strings anchored each at one end to said body portion and extending over said fret members, (d) string deviation detector means located intermediate between said body portion and said plurality of fret members, said string devication detector means being operative to produce lateral displacement responsive to deviation of each of said strings in a lateral direction of said body portion for producing a signal variable with a detected amount of deviation of each string in the lateral direction of said body portion, and (e) engaging means engaging said string deviation detector means for fixedly maintaining the positional relationship between each of said strings and said string deviation detector means.

* * * * *